US005819500A

United States Patent [19]

Haraguchi et al.

[11] Patent Number: 5,819,500

[45] Date of Patent: Oct. 13, 1998

[54] MEDICATION PACKAGING APPARATUS

[75] Inventors: Manabu Haraguchi, Gunma-ken; Kazushi Yamaoka, Ota, both of Japan

[73] Assignee: Sanyo Electric Co., Ltd., Osaka, Japan

[21] Appl. No.: 706,984

[22] Filed: Aug. 23, 1996

[30] Foreign Application Priority Data

Aug. 23, 1995 [JP] Japan ..... 7-237604

[51] Int. Cl.[6] ..... B65B 35/54

[52] U.S. Cl. ..... 53/154; 53/155; 53/168; 53/237; 53/238; 53/550; 53/562

[58] Field of Search ..... 221/94, 95, 123, 221/132, 133; 53/154, 155, 168, 237, 238, 493, 550, 562

[56] References Cited

U.S. PATENT DOCUMENTS

| | | | |
|---|---|---|---|
| 3,611,658 | 10/1971 | Dwyer | 53/562 X |
| 3,672,119 | 6/1972 | Gess | 53/562 X |
| 4,161,249 | 7/1979 | Dashow | 206/411 X |
| 4,512,462 | 4/1985 | Dills | 206/411 X |
| 4,870,799 | 10/1989 | Bergerioux et al. | 53/168 X |
| 5,060,450 | 10/1991 | Greenwell et al. | 53/562 X |
| 5,097,652 | 3/1992 | Inamura et al. | 53/154 X |
| 5,097,982 | 3/1992 | Kedem et al. | 221/94 X |
| 5,181,365 | 1/1993 | Garvey et al. | 53/562 X |
| 5,208,762 | 5/1993 | Charhut et al. | 53/493 X |
| 5,481,855 | 1/1996 | Yuyama . | |
| 5,502,944 | 4/1996 | Kraft et al. | 53/168 X |

FOREIGN PATENT DOCUMENTS

| | | |
|---|---|---|
| 0 412 806 A1 | 2/1991 | European Pat. Off. . |
| 2 145 774 | 2/1973 | France . |

*Primary Examiner*—Daniel Moon
*Attorney, Agent, or Firm*—Darby & Darby

[57] ABSTRACT

A medication packaging apparatus for packaging solid medications specified by prescriptions at a hospital, pharmacy, etc. The medication packaging apparatus is equipped with: a plurality of tablet cases which hold solid medications separately by type; a turntable which is located under the tablet cases and which turns to receive and gather the medications at the outer periphery thereof by the centrifugal force thereof; a guide which is formed around the turntable and which has a dispensing port; and a heat sealing mechanism for forming a roll of thermally weldable packaging paper into small bags in succession. The mechanism for collecting the medications which have been released from the tablet cases can be made thinner and therefore, the entire medication packaging apparatus can be made smaller.

3 Claims, 5 Drawing Sheets

MEDICATION PACKAGING APPARATUS

BACKGROUND OF THE INVENTION

1. Field of the Invention

The present invention relates to a medication packaging apparatus for packaging, with packaging paper, medications (the medications hereinafter mean tablets, capsules, pills, lozenges, and any other solid medications) specified by prescriptions at hospitals, pharmacies, etc.

2. Description of the Related Art

Conventionally, at a hospital or the like, a plurality of types of tablets (solid medications) prescribed by a doctor are packed by dividing them for each dose by using a tablet packaging machine as disclosed, for example, in Japanese Patent Publication No. 3-59 (A61J3/00) before supplying them to a patient. Such a divide-and-pack method, however, is basically designed to dispense tablets for each dose and collect them using a hopper, conveyor, or the like to package them, thus requiring much time for completing the packaging, including the waiting time for collecting the tablets. Moreover, the whole apparatus unavoidably becomes large because it solely depends on gravitational force to collect the tablets by using such a hopper, conveyor, or the like.

There is another type of tablet filling apparatus; it charges prescribed tablets in containers such as vials and bags for each type of tablets for a patient. This type of conventional tablet filling apparatus is designed to arrange a plurality of tablet cases, each of which is filled with a different type of tablets, like a row of lockers with the tablet cases slanted down to the front. Each tablet case is equipped with a dispensing mechanism for dispensing the tablets from an associated tablet case according to a prescription.

Such a tablet filling apparatus requires less time to complete the charging of tablets than in the aforesaid tablet packaging machine since it does not divide the tablets by dose; however, it requires that an operator go to a required tablet case and fill a container with the tablets released from the dispensing mechanism. Therefore, especially when there are many types of tablets, the work for filling different types of containers with different types of tablets becomes extremely complicated and time-consuming.

Further, the plurality of tablet cases which are disposed on a wall surface like a row of lockers prevent the reduction in the size of the whole apparatus, whereas reduced size has been required of the conventional tablet packaging machine.

SUMMARY OF THE INVENTION

Accordingly, the present invention has been made with a view toward solving such problems with the prior art and it is an object of the present invention to provide a medication packaging apparatus which permits shortened time for packaging medications and a reduced size of the whole apparatus.

To this end, according to one aspect of the present invention, there is provided a medication packaging apparatus which is equipped with: a plurality of tablet cases for holding medications separately by type; a turntable which is located under the tablet cases and which rotates to receive the medications dispensed from the tablet cases; a guide provided around the turntable; a dispensing port which is formed on the guide; packaging paper which has been wound into a roll and which is thermally weldable; and a heat sealing mechanism for forming continuous small bags by heat-sealing the packaging paper. When medications dispensed through the dispensing port have been placed in the packaging paper, the heat sealing mechanism seals the packaging paper. With this arrangement, a thinner mechanism may be used for collecting the medications dropped from the tablet cases, allowing a reduced size of the entire medication packaging apparatus. This will contribute to effective use of limited, valuable spaces at facilities such as hospitals and pharmacies.

According to another aspect of the present invention, the medication packaging apparatus is further equipped with: a feeding means for feeding the mounted roll of packaging paper; a guiding means for guiding the fed packaging paper to a predetermined position; and a pull-in means for pulling the leading edge of the packaging paper which has been guided by the guiding means. This arrangement allows the packaging paper to be automatically fed out without human aid and threaded in the predetermined position once the roll of packaging paper is mounted in place. Hence, it is no longer necessary to manually set the roll of packaging paper in place, resulting in a markedly shortened time for mounting or replacing the packaging paper.

According to a further aspect of the present invention, the leading edge of the roll of packaging paper is provided with a hard section of a predetermined dimension. This minimizes the chance of bending of the leading edge of the packaging paper, ensuring smooth feeding of the packaging paper. This feature contributes to reliable and smooth automatic threading of the packaging paper.

DESCRIPTION OF THE PREFERRED EMBODIMENT

The present invention will be described in further detail with reference to the accompanying drawings.

Figure 1:
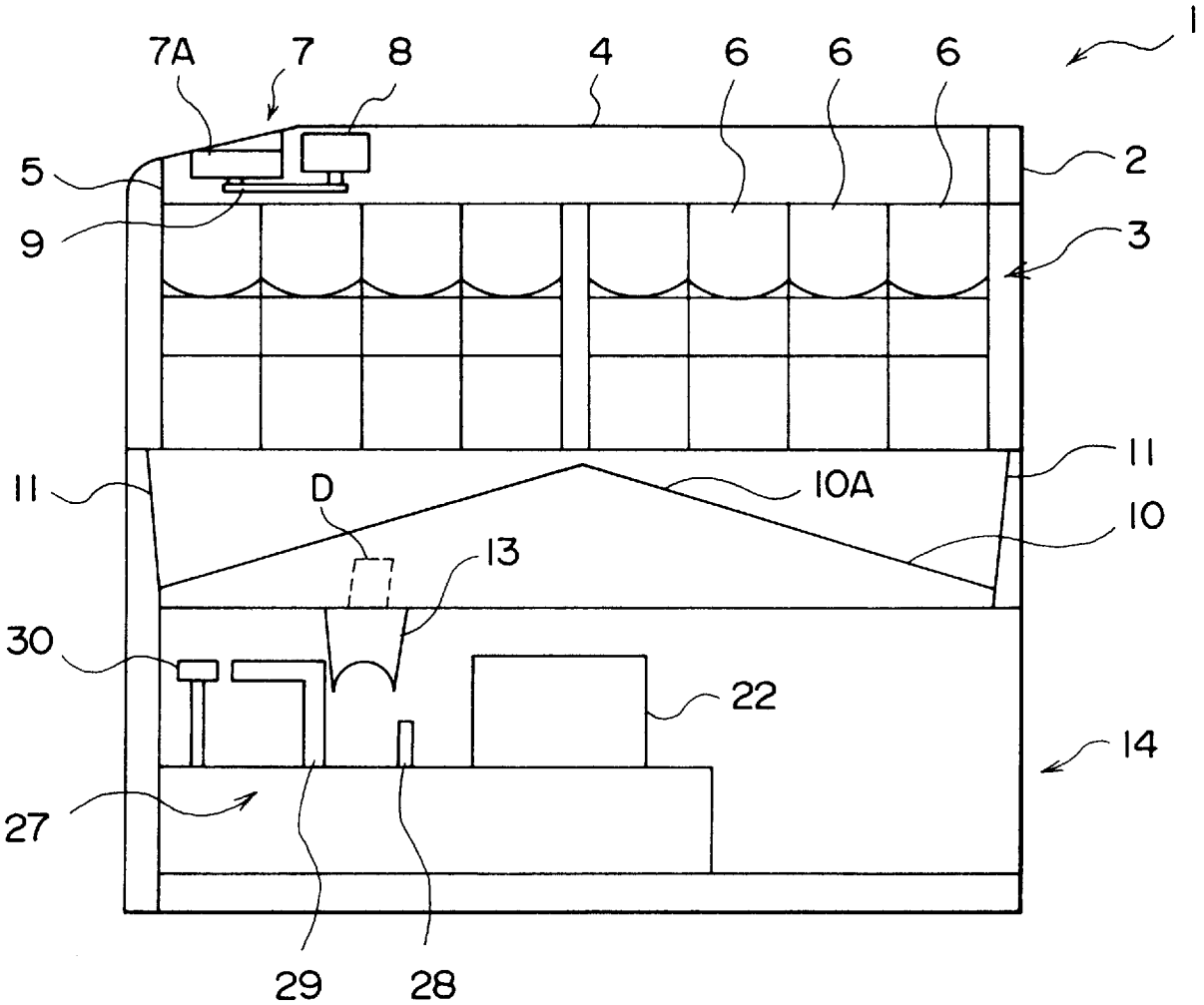
FIG. 1 is a longitudinal sectional side view of a medication packaging apparatus in accordance with the present invention.
Figure 2:
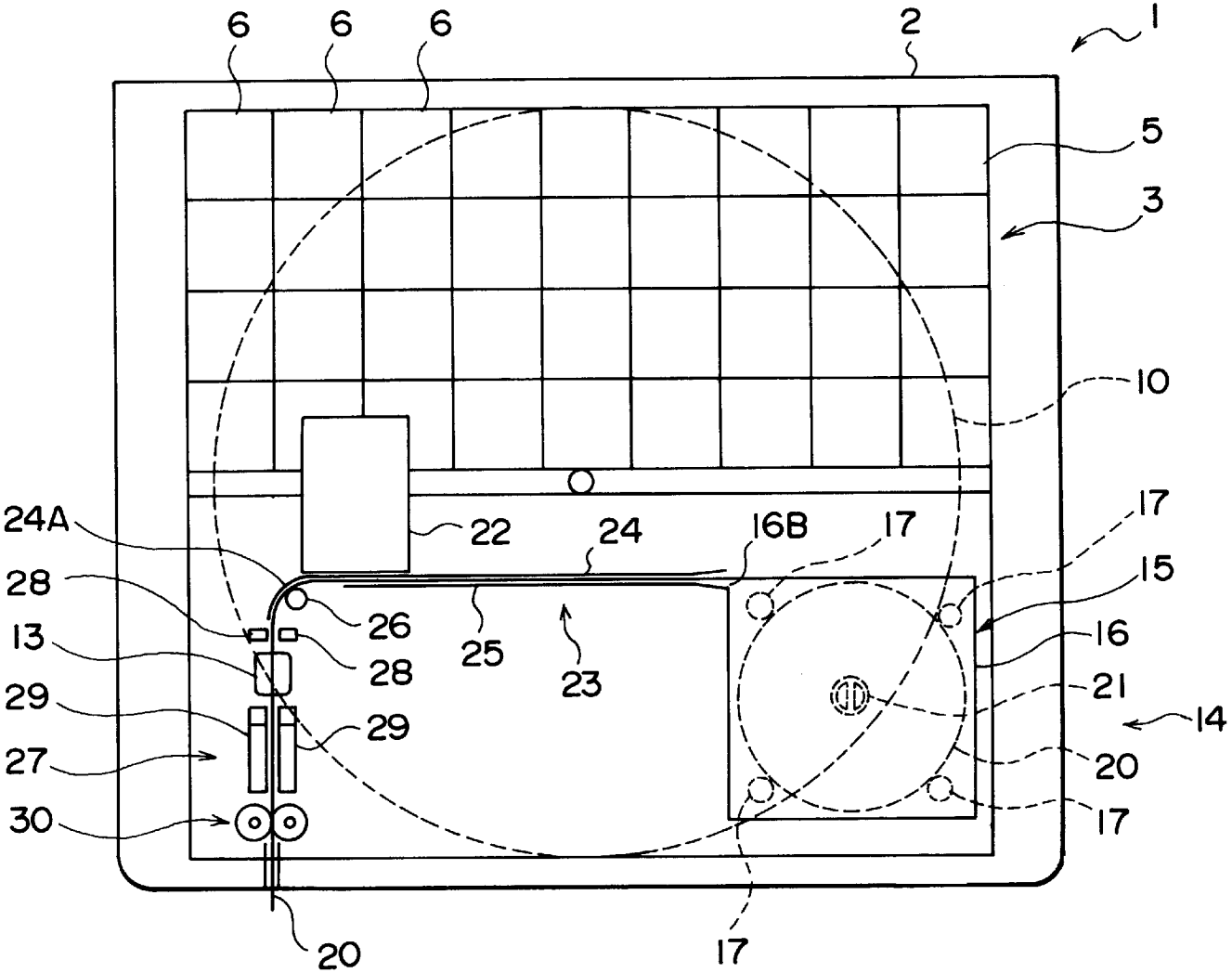
FIG. 2 is a top sectional view showing the medication packaging apparatus in accordance with the present invention.
Figure 3:
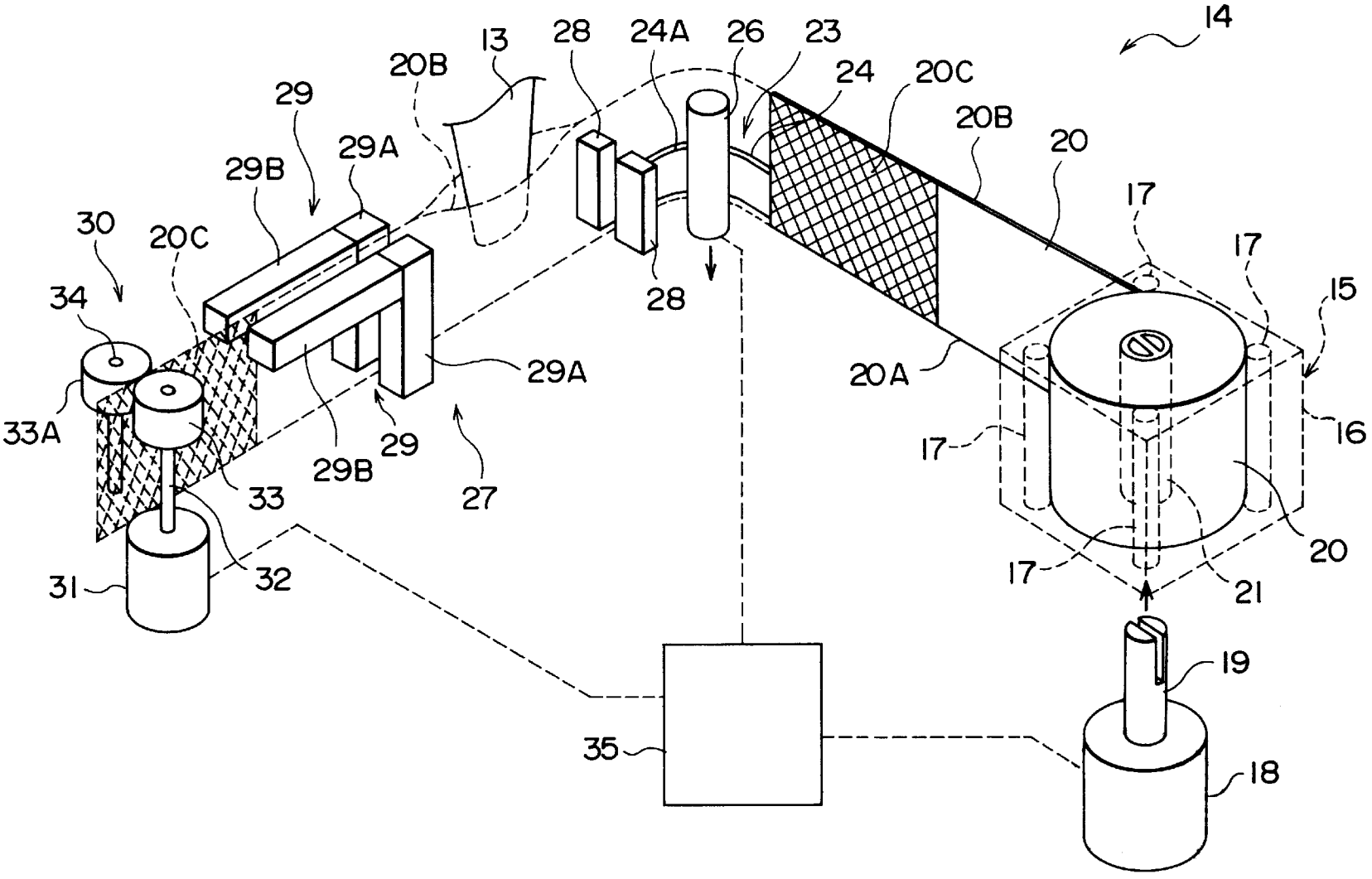
FIG. 3 is a perspective view showing a mediation packaging mechanism of the medication packing apparatus in accordance with the present invention.
Figure 4:
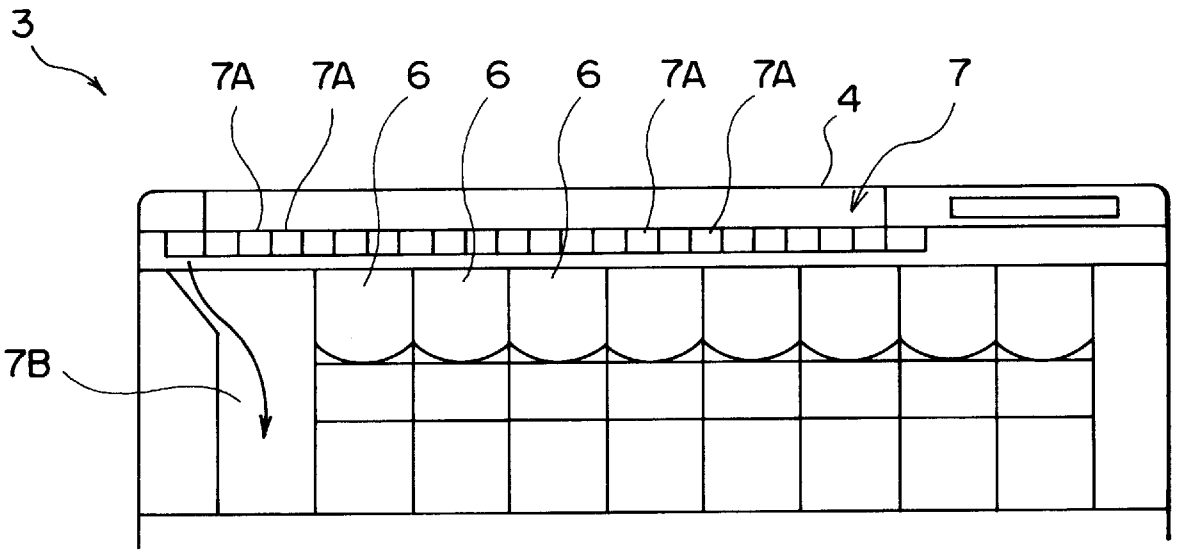
FIG. 4 is a longitudinal sectional front view showing a tablet case assembly of the medication packaging apparatus in accordance with the present invention.
Figure 5:
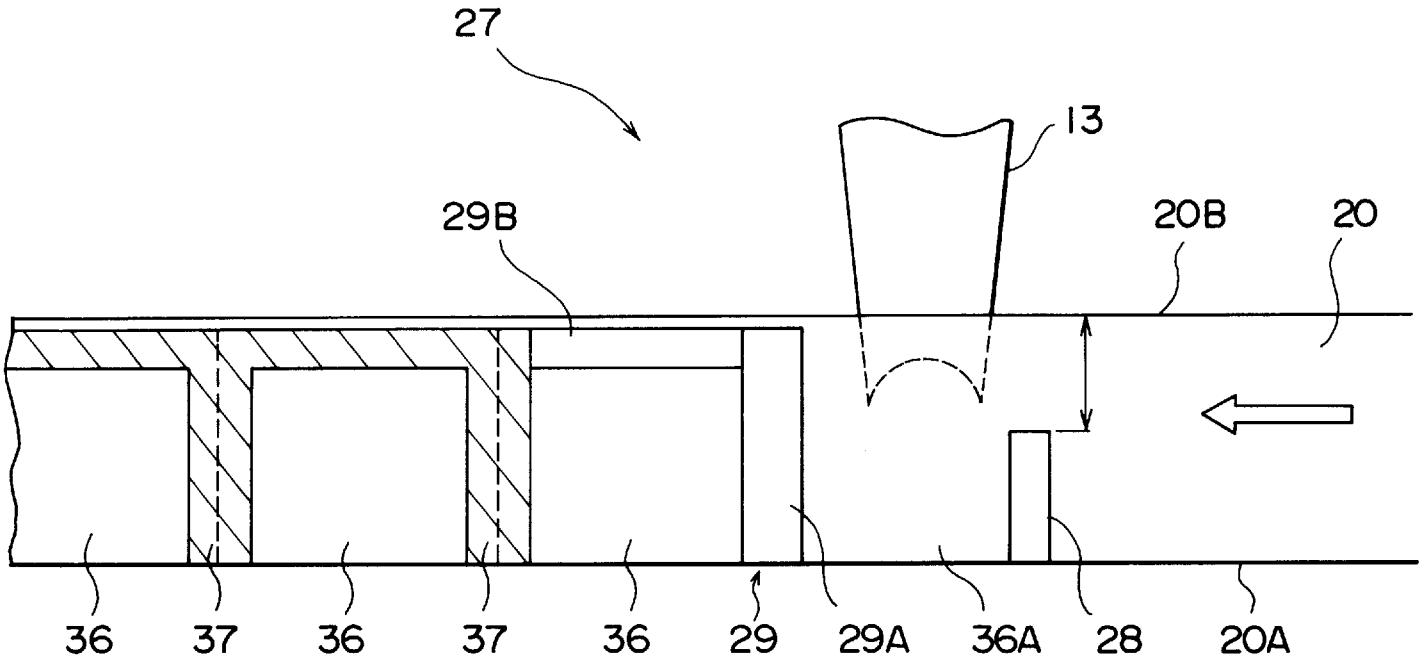
FIG. 5 is a side view showing a heat sealing mechanism of the medication packaging apparatus in accordance with the present invention.

FIG. 1 is a longitudinal sectional side view of a medication packaging apparatus 1 in accordance with the present invention; FIG. 2 is a top sectional view showing the medication packaging apparatus in accordance with the present invention; FIG. 3 is a perspective view showing a medication packaging mechanism 14; FIG. 4 is a longitudinal sectional front view showing a tablet case assembly 5; and FIG. 5 is a side view showing a heat sealing mechanism 27.

A medication filling apparatus 1 according to the present invention is intended to be installed at a hospital, pharmacy, or the like; it is constituted primarily by a medication holding mechanism 3 installed in a rectangular outer case 2 and the medication packaging mechanism 14 provided below the medication holding mechanism. A tablet case assembly 5 of the medication holding mechanism 3 is disposed at the top inside the rectangular outer case 2; the tablet case assembly 5 is open upward and it is provided with a top table 4 which opens and closes the tablet case assembly 5.

Housed in the tablet case assembly 5 are a plurality of tablet cases 6; sub-holders 7 are provided at the front top thereof. The sub-holders 7 are used to hold medications such as tablets which have been cut into halves and which cannot be held in the tablet case 6. A belt conveyor, which is not shown and which may be connected using a chain, gear, or the like, is driven by a belt 9 mounted on a pulley of a rotary shaft, not shown, of a motor 8. The belt conveyor is provided with a plurality of continuous holding sections 7A.

Provided beneath the respective tablet cases 6 are dispensing and counting devices comprised of photosensors, etc. which are not shown. The dispensing and counting devices are respectively communicated with the tablet cases 6 located over them, a motor-driven dispenser drum being incorporated therein. A plurality of vertical grooves are formed on the side surface of the dispenser drum, so that solid medications such as tablets, capsules, pills, and lozenges are vertically aligned in each of these groove. As the dispenser drum rotates, the medications in each groove drop one by one and counted by the photosensor.

On one side of the sub-holders 7, a dropping passage 7B is formed; the drop passage 7B is communicated with a turntable 10 which will be discussed later. The medications mentioned above are held in the holding sections 7A of the sub-holder 7; as the motor 8 is started by a switch operated by a user, the medications are dropped from the holding sections 7A through the drop passage 7B as shown by an arrow in FIG. 4.

Provided below the tablet cases 6 and the drop passage 7B is a disc-shaped turntable 10 for collecting the medications; the turntable 10 has an area which is sufficiently large for the bottom area of all the tablet cases 6 and the drop passage 7B. The turntable 10 has a projecting cone 10A at the center thereof, the turntable 10 is driven and rotated at a predetermined speed by a turntable motor (not shown) which is provided below the cone 10A. With this arrangement, the medications dropped from the tablet cases 6 and the sub-holders 7 can be collected on the outer periphery toward a guide 11 by the centrifugal force of the turntable 10 which rotates, thus enabling the mechanism for collecting the medications to be made extremely thin.

The annular guide 11 is provided vertically around the turntable 10; a notch-shaped dispensing port D is formed at an appropriate point. A chute 13, which will be discussed hereinafter, is provided below the dispensing port D; as the turntable 10 rotates, the medications which have been gathered toward the guide 11, i.e. toward the outer periphery, drop onto the chute 13. The chute 13 is shaped like a cylindrical inverted cone; the upper end opening matches the dispensing port D of the turntable 10 and the open bottom end, i.e. the distal end, is inserted in folded packaging paper 20.

The medication packaging mechanism 14 is provided under the turntable 10; the medication packaging mechanism 14 is constructed by a feeding means for feeding out the packaging paper 20, a guiding means for guiding the fed-out packaging paper 20 to a predetermined position, and a pull-in means for pulling the leading edge of the packaging paper 20. The packaging paper feeding means is composed of a detachable housing case 15 and a feeding motor 18. The feeding motor 18 employs a servo mechanism which permits easy revolution control; it is designed to run for a predetermined time at a predetermined r.p.m. in response to a received input. A rotary shaft (hereinafter referred to as a "fitting shaft") 19 of the feeding motor 18 is detachably fitted to a hollow shaft 21, around which the packaging paper 20 is wrapped, in the housing case 15.

The packaging paper 20 will now be described. The packaging paper 20 is adapted to hold and package medications; it is made of thermally weldable thin paper which uses, as an auxiliary medium, a thermally weldable material such as polyethylene which melts at a predetermined temperature. The packaging paper 20 has a predetermined width and it is wrapped around the hollow shaft 21; it is further folded approximately at the center of the width thereof to provide a bent section 20A and an opened section 20B which are composed of the two edges on the opposite side from the bent section 20A. The packaging paper 20, which has been creased and folded lengthwise, is wound around the hollow shaft 21; the leading edge of the packaging paper 20 is provided with a hard section 20C.

The hard section 20C serves to prevent the packaging paper 20 from being easily deformed when threading it from a guide rail 23 to a pull-in roller 30; it is formed in a predetermined length from the leading edge of the packaging paper 20. The hard section 20C is formed, for example, by thermally welding the whole area over the predetermined length from the leading edge of the packaging paper 20, i.e. the roll end of the packaging paper 20 which has been folded and wrapped around the hollow shaft 21. This makes the leading edge of the packaging paper 20 resistant to bending when it is threaded from the guide rail 23 to the pull-in roller 30.

The housing case 15 is used to rotatably house the packaging paper 20 in a main body 16 which is an enclosure; a through hole, not shown, is formed at about the center of the bottom surface of the main body 16. The through hole is formed so that the fitting shaft 19 of the feeding motor 18 may be inserted; it is made slightly larger than the fitting shaft 19. Provided inside the main body 16 are a plurality of guide rollers 17 of a predetermined columnar shape; the guide rollers 17 are located at about the four corners of the housing case 15 in such a manner that they extend from the bottom surface where the through hole is formed to the top surface. The guide rollers 17 are provided with a slight gap in relation to the outer peripheral surface of the roll of the packaging paper 20 so as to permit smooth rolling of the loaded packaging paper 20.

Provided beside the guide roller 17 inside the housing case is a feeding outlet 16B for feeding out the packaging paper 20 loaded inside the main body 16. The feeding outlet 16B is made slightly larger than the width and thickness of the packaging paper 20 so that the packaging paper 20 may be easily fed out of the housing case 15. The packaging paper 20 is rotatably installed in the housing case 15 so that the bent section 20A thereof is positioned at the bottom while the open section 20B thereof is positioned at the top, with the hard section 20C slightly sticking out of the feeding outlet 16B of the housing case 15.

The medication packaging mechanism 14 is provided with the guide rail 23 which continues from the side of the housing case 15 and which serves as a guiding means; the feeding outlet 16B of the housing case 15 is disposed on the guide rail 23 side. The guide rail 23 is composed of two guide plates 24 and 25 (the guide plate 25 is not shown in FIG. 3) which are approximately half as high as the packaging paper 20. A predetermined gap is provided between the guide plate 24 and the guide plate 25 to allow the packaging paper 20 to pass through easily; the gap is formed slightly larger at the end toward the housing case 15 so as to make it easy to lead the packaging paper 20, which has been drawn out of the housing case 15, to the guide rail 23.

The guide plate 24 is provided with a curved section 24A on the opposite side from the housing case 15. A tension roller 26 is provided inside the curved section 24A with a predetermined interval between them; the tension roller 26 is movably installed in the direction away from the curved section 24A and it is urged toward the curved section 24A by a predetermined working force applied by a coil spring, a flat spring, or the like which is not shown. The position of the tension roller 26 is detected by a switch, not shown. The other guide plate 25 is positioned between the tension roller 26 and the housing case 15; it is located with a predetermined distance from the tension roller 26.

The pull-in roller 30 serving as the pull-in means is provided ahead of the bent section 24A of the guide plate 24. The guide roller 30 is constructed by a pair of narrow rubber rollers 33 and 33A made of natural rubber, synthetic rubber, or the like; it is mounted on the tops of rotary shafts 32 and 34. Provided at the bottom of the rotary shaft 32, to which the rubber roller 33 is attached, is a pull-in motor 31; the rotary shaft 32 provides the rotary shaft of the pull-in motor 31.

The rotary shaft 34 of the other rubber roller 33A is urged by a coil spring or the like, which is not shown; the rubber roller 33A is pressed against the rubber roller 33 under a predetermined pressure, so that both rubber rollers 33 and 33A rotate as the pull-in motor 31 runs. The packaging paper 20 is held between the rubber rollers 33 and 33A to be drawn out from the housing case 15 and moved to the opposite side.

A heat sealing mechanism 27 is provided between the guide rail 23 and the pull-in roller 30. The heat sealing mechanism 27 seals the opened section 20B of the packaging paper 20 by thermal welding to divide and package medications by each dose; it is constituted by a pair of pre-heaters 28, 28 and a pair of main heaters 29, 29 which are installed facing against each other with a predetermined gap provided between them. One of the pre-heaters 28 and one of the main heaters 29 are equipped with a moving device so that they may be moved to be pushed against or moved away from the counterparts thereof. When electric currents are supplied to the pre-heaters 28, 28 and the main heaters 29, 29, these heaters become hot to a predetermined temperature.

The main heaters 29, 29 respectively have vertical sections 29A, 29A and parallel sections 29B, 29B; the parallel sections 29B are approximately as wide as the pre-heaters 28 while the vertical sections 29A are twice as wide as the parallel sections 29B. The pre-heaters 28 clamp the packaging paper 20 from both sides thereof and heat it to thermal weld it to about the middle of the opened section 20B from the bent section 20A of the packaging paper 20, except the area indicated by the arrow drawn by a solid line in FIG. 5.

Then, the vertical sections 29A of the main heater 29 clamp, from both sides, the top section of the packaging paper 20, which has been heated and thermally welded by the pre-heaters 28, and thermally weld the packaging paper 20 from the bent section 20A to the opened section 20B to fix it so as to form a small bag 36A, which has the opened section 20B on one end thereof, on the pre-heaters 28 side. The parallel sections 29B are adapted to thermally weld the opened section 20B on the opposite side from the pre-heaters 28. This means that the thermal welding is carried out over the distance from the main heaters 29 to the pre-heaters 28.

After the packaging paper 20 is thermally welded by the heat sealing mechanism 27, it is moved for a predetermined distance by the rotation of the pull-in roller 30 toward the pull-in roller 30 as indicated by the blank arrow shown in FIG. 5. Thus, the part which has been thermally sealed by the pre-heaters 28 is moved to the vertical sections 29A of the main heaters 29. Then, the main heaters 29 thermally weld the packaging paper 20 to form one after another the small bag 36A, which has the opened section 20B, between the pre-heaters 28 and the vertical sections 29A of the main heaters 29; and a small bag 36, which is thermally sealed except the bent section 20A, is formed on the pull-in roller 30 side.

When thermally sealing the packaging paper 20 from the bent section 20A to the opened section 20B by the vertical sections 29A of the main heaters 29, perforation 37 is formed at about the middle of the width of the thermally sealed section, i.e. from the bent section 20A to the opened section 20B. This thermally seals three sides of the packaging paper 20, the remaining side being the bent section 20A, thus completing the small bag with all sides thereof sealed. The small bag 36 can be separated at the perforation 37. A printer 22 prints the name, usage, etc. of the packaged medications on each small bag 36.

The operation of the medication packaging apparatus 1 will now be described. It is assumed that the aforesaid packaging paper 20 has been loaded in the housing case 15 and the feeding motor 18, the lead-in motor 31, the switch of the tension roller 26 have been connected to a controller 35. It is further assumed, for instance, when the housing case 15 is mounted in a predetermined position, a switch which is not shown is turned ON and the controller 35 supplies electric currents to the motors 18 and 31. At this time, the fitting shaft 19 of the feeding motor 18 moves in through the through hole in the bottom surface of the housing case 15 to fit into the hollow shaft 21 of the packaging paper 20.

With this arrangement, when the feeding motor 18 runs, the packaging paper 20 is unrolled and fed out through the feeding outlet 16B of the housing case 15 and the hard section 20C formed at the leading edge of the packaging paper 20 is moved through the guide plates 24 and 25 of the guide rail 23 toward the curved section 24A. When the hard section 20C of the packaging paper 20, which has been fed out, reaches the curved section 24A of the guide rail 23, it passes between the curved section 24A and the tension roller 26 and further passes through the pre-heaters 28, 28 and the main heaters 29, 29 until it finally reaches the pull-in roller 30, the packaging paper 20 being shown by the dashed line in FIG. 3.

As soon as the packaging paper 20 reaches the pull-in roller 30, the two rubber rollers 33 and 33A of the pull-in roller 30 are pressed against each other to pull the packaging paper 20 from the guide rail 23 to the other side, i.e. on this side. Thus, the packaging paper 20 is drawn by the pull-in roller 30 to this side. In this case, since the leading edge of the packaging paper 20 is provided with the hard section 20C, the packaging paper 20, which has been fed out of the housing case 15, remains resistant to bending and does not deviate from the guide rail 23, the pre-heaters 28, 28, or the main heaters 29, 29 until it reaches the pull-in roller 30. This makes it possible to guide and thread the packaging paper 20 in the predetermined position without any human aid.

The running speeds of the feeding motor 18 and the lead-in motor 31 are so set that the movement of the packaging paper 20 when it is drawn in by the pull-in roller 30 is larger than the movement of the packaging paper 20 when it is fed out of the housing case 15 in order to generate a predetermined level of tensile force between the housing case 15 and the pull-in roller 30. This causes the part of the packaging paper 20 which is positioned between the guide rail 23 and the pre-heaters 28 to deflect inward between the inner guide plate 25 and the pre-heaters 28. In other words, the tension roller 26 is moved away from the curved section 24A of the guide rail 23 or the guide plate 24 as indicated by the arrow of the solid line in FIG. 3.

Such movement of the tension roller 26 is detected by the aforesaid switch and the controller 35 stops the feeding motor 18 and the lead-in motor 31. Under this condition, the bottom end of the chute 13 is inserted in the opened section 20B of the folded packaging paper 20 between the pre-heaters 28 and the main heaters 29.

When the controller 35 detects the movement of the tension roller 26 and stops the feeding motor 18 and the lead-in motor 31, it does not supply electric currents to the feeding motor 18; it makes only the lead-in motor 31 run until the packaging paper 20 is loaded next.

Thus, according to the present invention, once the housing case 15, which contains the packaging paper 20 provided with the hard section 20C at the leading end thereof, is mounted in the predetermined position of the medication packaging mechanism 14, the packaging paper 20 is automatically fed out without the need of human aid and routed from the guide rail 23 to the pull-in roller 30 through the heat sealing mechanism 27. Hence, the conventional time-consuming complicated mounting and threading of the roll of packaging paper by hand is no longer necessary and almost no mounting failure of the packaging paper 20 occurs. This enables markedly shortened time required for loading or replacing the packaging paper 20, which in turn leads to shortened patient waiting time.

Moreover, the hard section 20C of the predetermined length provided at the leading end of the packaging paper 20 minimizes the chances for the leading end of the packaging paper 20 to bend, permitting the packaging paper to be fed out smoothly along the guide rail 23. This makes it possible to prevent the failure of threading the packaging paper 20, enabling more reliable and smoother automatic threading of the packaging paper 20.

Turning ON the power of the medication packaging apparatus 1 with the packaging paper 20 mounted resets the count value of the dispensed medications and other values. It is assumed that the pre-heaters 28 and the main heaters 29 have been heated to a predetermined temperature and electric currents are being supplied to the turntable 10 to rotate it at all times.

When an operator keys in prescription data to an input unit such as a personal computer, not shown, according to a prescription supplied by a doctor, the dispensing drum for the tablet case 6, holding the required medication is driven and rotated and the medications of the specified type are dispensed one by one onto the turntable 10. The medications in the sub-holder 7 are also released onto the turntable 10 as required by the operator.

The medications which have been dispensed from the tablet case 6 are counted by the controller 35 according to the outputs of the photosensor; when the count value of the dispensed medications coincides with the number of the medications specified in the prescription data, the dispensing drum is stopped so as to stop dispensing the medications. The medications including the medications from the sub-holder 7 which have dropped onto the turntable 10 are moved toward the outer guide 11 by the centrifugal force of the rotating turntable 10; the medications which have been thus gathered toward the guide 11 fall into the chute 13 located at the bottom through the dispensing port D provided on the guide 11.

After that, the medications pass through the chute 13 into the small bag 36A of the packaging paper 20 located beneath the chute 13. After the medications are placed in the small bag 36A of the packaging paper 20, the controller 35 pulls the packaging paper 20 by the pull-in roller 30 and seals the small bag by thermal welding by the heat sealing mechanism 27 as described above.

At this time, the pre-heaters 28 of the heat sealing mechanism 27 thermally weld from the bent section 20A to approximately halfway to the opened section 20B, leaving the top thereof unwelded so as to allow the packaging paper 20 to be drawn in by the pull-in roller 30 in the direction indicated by the arrow in FIG. 5 without raising the chute 13. When the packaging paper 20 stops moving, the main heaters 29 thermally weld the packaging paper 20 again to completely seal the medications in the small bag 36A. The moment the sealing the medications in small bag 36A is completed, the next batch of the medications is put in the next small bag 36A from the turntable 10 through the chute 13. A predetermined number of medications of the type specified in the prescription data are automatically packaged by repeating the process described above.

Thus, since the turntable 10 is rotated at the predetermined speed to gather the medications to the dispensing port D of the guide 11, even if the medications are released onto the turntable 10 from the tablet cases 6 and the sub-holders 7 at random, the released medications can be easily gathered at the guide 11 by the centrifugal force and dropped through the dispensing port D into the opening of the packaging paper. This arrangement enables the medication gathering mechanism to be made thinner and therefore makes it possible to reduce the size of the whole medication packaging apparatus 1, thus contributing to effective use of the limited, valuable space at such facilities as hospitals and pharmacies.

In the embodiment, the hard section 20C at the leading end of the packaging paper 20 has been formed by thermally welding the leading end of the packaging paper 20 for the predetermined dimension; however, the hard section 20C may alternatively be formed, for example, by putting paper, a vinyl material, or the like, which has the similar thickness and hardness to the packaging paper 20, in the folded packaging paper 20 and by thermally welding them.

As described in detail above, according to the present invention, the turntable which turns and receives dispensed medications is provided below the plurality of tablet cases which hold medications separately by type; the guide equipped with a dispensing port is formed around the turntable; the medications, which have been dispensed through the dispensing port, are put in the packaging paper; then the packaging paper is sealed by the heat sealing mechanism; therefore, the mechanism for collecting the medications, which have been released from the tablet cases, can be made thinner and the entire medication packaging apparatus can accordingly be made smaller. This contributes to effective use of the limited, valuable space at such facilities as hospitals and pharmacies.

Moreover, the mounted roll of packaging paper is fed out by the feeding means, the fed-out packaging paper is guided to the predetermined positions by the guiding means, and the leading end of the guided packaging paper is drawn by the pull-in means; therefore, once the roll of the packaging paper is mounted in place, the packaging paper can be automatically fed out and threaded as specified without the need for human aid. Thus, the conventional time-consuming complicated mounting and threading of the roll of packaging paper in the predetermined position by hand is no longer necessary, enabling markedly shortened time required for loading or replacing the packaging paper.

Furthermore, since the leading end of the roll of the packaging paper is provided with the hard section of the predetermined dimension, the leading end of the packaging paper is resistant to bend, permitting easy feed of the packaging paper. This allows more reliable and smoother automatic threading of the packaging paper.

Thus, the medication packaging apparatus in accordance with the present invention is useful as a medicine packaging machine installed at a hospital, pharmacy, etc.; in particular, it is ideally suited for use at a small hospital, pharmacy, or other similar facilities.

What is claimed is:

1. A medication packaging apparatus, comprising:

a plurality of tablet cases for holding solid medications separately by type and from which the solid medications are selectively dispensed;

a rotatable, conical shaped turntable located under said tablet cases to receive solid medications dispensed from said tablet cases;

a guide provided around said turntable;

a dispensing port formed on said guide for dispensing the solid medications carried thereto by centrifugal force as said turntable rotates;

a strip of thermally weldable packaging paper having a closed bottom and an open top through which the medications dispensed through said guide dispensing port are loaded into said strip; and a heat sealing mechanism for forming continuous small bags of sections of said strip of said packaging paper into which the dispensed medications have been loaded.

2. A medication packaging apparatus according to claim 1, wherein said strip of packaging paper is in a roll having a free leading edge and further comprising:

feeding means for feeding out a section of said packaging paper from said roll to a predetermined position to have the medication loaded therein from said dispensing port;

guiding means for guiding said packaging paper which has been fed to said predetermined position; and pull-in means for pulling said leading edge of said packaging paper to be guided by said guiding means.

3. A medication packaging apparatus according to claim 2, wherein said leading edge of said roll of packaging paper is provided with a hard section of a predetermined dimension.

* * * * *